US008248322B1

(12) United States Patent
Patel

(10) Patent No.: US 8,248,322 B1
(45) Date of Patent: Aug. 21, 2012

(54) WIDEBAND COMPOSITE POLARIZER AND ANTENNA SYSTEM

(75) Inventor: Kanti N. Patel, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 13/449,253

(22) Filed: Apr. 17, 2012

Related U.S. Application Data

(62) Division of application No. 12/474,208, filed on May 28, 2009, now Pat. No. 8,184,057, which is a division of application No. 11/403,808, filed on Apr. 14, 2006, now Pat. No. 7,564,419.

(51) Int. Cl.
*H01Q 13/10* (2006.01)
*H01Q 3/10* (2006.01)
*H01Q 19/10* (2006.01)

(52) U.S. Cl. ..... 343/786; 343/772; 343/756; 343/909; 343/758

(58) Field of Classification Search ..... None
See application file for complete search history.

(56) References Cited

U.S. PATENT DOCUMENTS 4,143,377 A 3/1979 Salvat et al.
4,253,100 A 2/1981 Commault et al.
4,353,041 A 10/1982 Bryans et al.
4,728,961 A 3/1988 Bossuet et al.
5,075,649 A 12/1991 Pellegrineschi
5,134,420 A 7/1992 Rosen et al.
5,235,297 A 8/1993 Tawil
5,473,334 A 12/1995 Yee et al.
5,745,082 A * 4/1998 Alder ..... 343/753
5,815,121 A 9/1998 Collier
5,973,654 A 10/1999 Lusignan et al.
7,564,419 B1 7/2009 Patel
7,623,085 B1 * 11/2009 Lier ..... 343/786
2002/0021256 A1 * 2/2002 Yuanzhu ..... 343/786
2002/0080081 A1 * 6/2002 Liu ..... 343/786
2002/0167452 A1 * 11/2002 Sasaki et al. ..... 343/785
2002/0181067 A1 12/2002 Romanovsky et al.
2003/0151790 A1 8/2003 Romanovsky
2004/0233117 A1 11/2004 Milroy et al.

* cited by examiner

*Primary Examiner* — Trinh Dinh
(74) *Attorney, Agent, or Firm* — McDermott Will & Emery LLP

(57) ABSTRACT

A composite polarizer including a first polarizer having a plurality of parallel metal vanes and a second polarizer having a plurality of parallel layers of dielectric material is provided. The first polarizer is disposed on an axis, and has a phase advance orientation orthogonal to the axis. The second polarizer is disposed on the axis and has a phase advance orientation orthogonal to the axis. The first polarizer has a first differential phase shift for a first frequency $f_1$ and a second differential phase shift for a second frequency $f_2$. The second polarizer has a first differential phase shift for the first frequency $f_1$ and a second differential phase shift for the second frequency $f_2$. A total of the first differential phase shifts of the first and second polarizers is about 90°, and a total of the second differential phase shifts of the first and second polarizers is about 90°.

3 Claims, 7 Drawing Sheets

WIDEBAND COMPOSITE POLARIZER AND ANTENNA SYSTEM

CROSS REFERENCE TO RELATED APPLICATIONS

This application is a divisional of U.S. patent application Ser. No. 12/474,208 entitled "WIDEBAND COMPOSITE POLARIZER AND ANTENNA SYSTEM," filed on May 28, 2009 and now issued as U.S. Pat. No. 8,184,057, which is a divisional of U.S. patent application Ser. No. 11/403,808 entitled "WIDEBAND COMPOSITE POLARIZER AND ANTENNA SYSTEM," filed on Apr. 14, 2006 and now issued as U.S. Pat. No. 7,564,419, which are hereby incorporated by references in their entirety for all purposes.

FIELD OF THE INVENTION

The present invention generally relates to polarizers and antenna systems and, more particularly, relates to wideband composite polarizers for antenna systems.

BACKGROUND OF THE INVENTION

In satellite antenna feed systems, there is frequently a need to convert electromagnetic signals between linear polarization and circular polarization. One approach to converting between these polarization states has been to dispose meander-line polarizers on the optical axes of the antenna feed systems.

Meander-line polarizers experience a number of drawbacks for satellite applications. Meander-line polarizers have little useful bandwidth individually, so numerous meander-line polarizers must be cascaded to be useful over a broad range of frequencies. Individually, meander-line polarizers are inadequate for handling high power loads, and when cascaded, meander-line polarizers experience power loss from the high number of interfaces in the cascade. Furthermore, meander-line polarizer cascades are difficult to fabricate and implement because of the complexity associated with the number of layers, all of which must be precisely oriented with respect to one another and with the optical axes.

Accordingly, there is a need for an affordable polarizer that can convert electromagnetic signals between linear polarization and circular polarization, with greater useful bandwidth, less loss and greater power handling capabilities. The present invention satisfies these needs and provides other advantages as well.

SUMMARY OF THE INVENTION

In accordance with the present invention, a rotatable composite polarizer including a parallel plate polarizer and an anisotropic dielectric polarizer provides a total differential phase shift of about 90°, allowing for conversion between linear and circular polarization of electromagnetic radiation. By rotating the composite polarizers about an axis, the differential phase shift may be "switched off," allowing incident linearly polarized radiation to pass through the polarizer without a change in polarization. Alternatively, the parallel plate polarizer and anisotropic dielectric polarizer may be rotated independently, allowing for the conversion between linear and elliptical polarization and the selection of right- or left-handedness for elliptical and circular polarization.

According to one embodiment of the present invention, a composite polarizer includes a first polarizer having a plurality of parallel metal vanes and a second polarizer having a plurality of parallel layers of dielectric material. The first polarizer has an axial thickness $t_1$, and each metal vane thereof has a breadth $b_1$, and is separated from an adjacent metal vane by a distance $d_1$. The parallel metal vanes are radially enclosed by a supporting frame. The first polarizer is disposed on an axis, and has a phase advance orientation orthogonal to the axis. The second polarizer has an axial thickness $t_2$, and each layer of dielectric material thereof has a breadth $b_2$ and is separated from an adjacent layer of dielectric material by a distance $d_2$. The second polarizer is disposed on the axis and has a phase advance orientation orthogonal to the axis. The first polarizer has a first differential phase shift for a first frequency $f_1$ and a second differential phase shift for a second frequency $f_2$. The second polarizer has a first differential phase shift for the first frequency $f_1$ and a second differential phase shift for the second frequency $f_2$. A total of the first differential phase shift of the first polarizer and the first differential phase shift of the second polarizer is about 90°, and a total of the second differential phase shift of the first polarizer and the second differential phase shift of the second polarizer is about 90°.

According to another embodiment of the present invention, an antenna system includes at least one linearly polarized antenna having a direction of linear polarization and an axis. The system further includes a rotatable parallel plate polarizer disposed on the axis in front of the at least one linearly polarized antenna. The rotatable parallel plate polarizer has a phase advance orientation substantially orthogonal to the axis. The system further includes a rotatable anisotropic dielectric polarizer disposed on the axis in front of the at least one linearly polarized antenna. The rotatable anisotropic dielectric polarizer having a phase advance orientation substantially orthogonal to the axis. When the phase advance orientation of the rotatable parallel plate polarizer is at an angle of about 45° or about 135° with respect to the direction of linear polarization and the phase advance orientation of the rotatable anisotropic dielectric polarizer is at an angle of about 45° or about 135° with respect to the direction of linear polarization, the rotatable parallel plate polarizer and the rotatable anisotropic dielectric polarizer have a combined differential phase shift for a first frequency $f_1$ of about 90° and a combined differential phase shift for a second frequency $f_2$ of about 90°.

According to yet another embodiment, an antenna system of the present invention includes a linearly polarized horn antenna having a direction of linear polarization and an axis. The system further includes a rotatable parallel plate polarizer disposed on the axis inside the linearly polarized horn antenna. The rotatable parallel plate polarizer has a phase advance orientation orthogonal to the axis. The system further includes a rotatable anisotropic dielectric polarizer disposed on the axis inside the linearly polarized horn antenna. The rotatable anisotropic dielectric polarizer has a phase advance orientation orthogonal to the axis. When the phase advance orientation of the rotatable parallel plate polarizer is at an angle of about 45° or about 135° with respect to the direction of linear polarization and the phase advance orientation of the rotatable anisotropic dielectric polarizer is at an angle of about 45° or about 135° with respect to the direction of linear polarization, the rotatable parallel plate polarizer and the rotatable anisotropic dielectric polarizer have a combined differential phase shift for a first frequency $f_1$ of about 90° and a combined differential phase shift for a second frequency $f_2$ of about 90°.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

Figure 1:
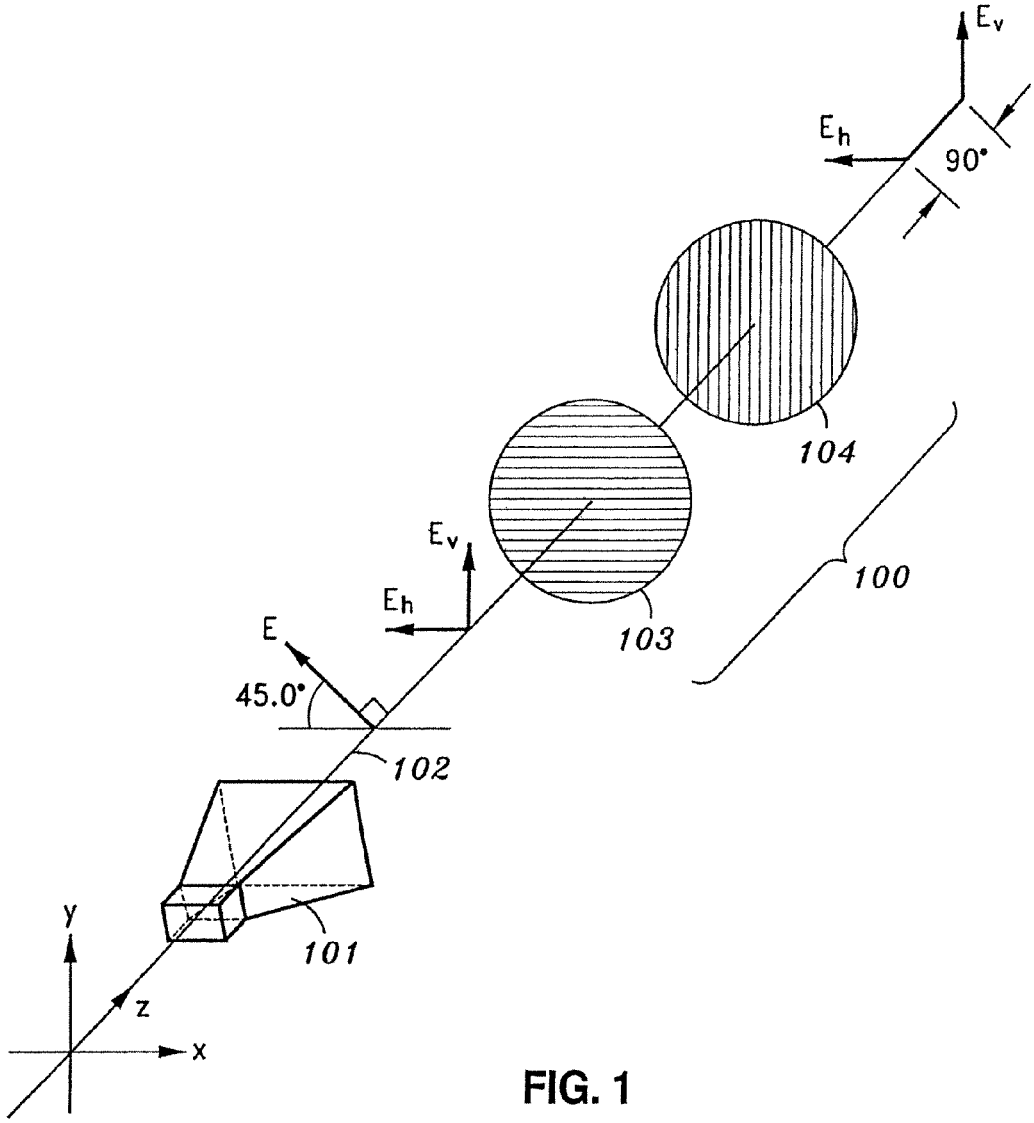
FIG. 1 depicts an exploded schematic view of a composite polarizer according to one embodiment of the present invention.

FIG. 1 illustrates an exploded schematic view of a composite polarizer 100 according to one embodiment of the present invention. A linearly polarized antenna 101 emits linearly polarized electromagnetic radiation along an axis 102. The linearly polarized electromagnetic radiation has an electric field orthogonal to the direction of propagation, as expressed by the electric field vector E. Electric field vector E can be expressed as the sum of mutually orthogonal component vectors $E_v$ and $E_h$. For convenience, the coordinate axes of FIG. 1 have been chosen such that the electric field vector E is at an angle 45° between horizontal and vertical. Accordingly, component vectors $E_v$ and $E_h$ of equal amplitude are oriented vertically and horizontally, respectively.

When the linearly polarized electromagnetic radiation passes through a parallel plate polarizer 103, the electric field vector is resolved into mutually orthogonal component vectors $E_v$ and $E_h$, which experience a differential phase shift because of the structure of parallel plate polarizer 103, as discussed more fully below. After passing through parallel plate polarizer 103, the electromagnetic radiation passes through an anisotropic dielectric polarizer 104, which, like parallel plate polarizer 103, exhibits a differential phase response. The differential phase responses for parallel plate polarizer 103 and anisotropic dielectric polarizer 104 depends both upon the structure of the polarizers and the frequency of the incident electromagnetic radiation. With the appropriate design of parallel plate polarizer 103 and anisotropic dielectric polarizer 104, a differential phase shift of about 90° for component vectors $E_v$ and $E_h$ can be accomplished over a broad bandwidth and/or over multiple widely separated frequency bands, thereby converting linearly polarized electromagnetic radiation emitted by antenna 101 to circularly polarized electromagnetic radiation.

Figure 2:
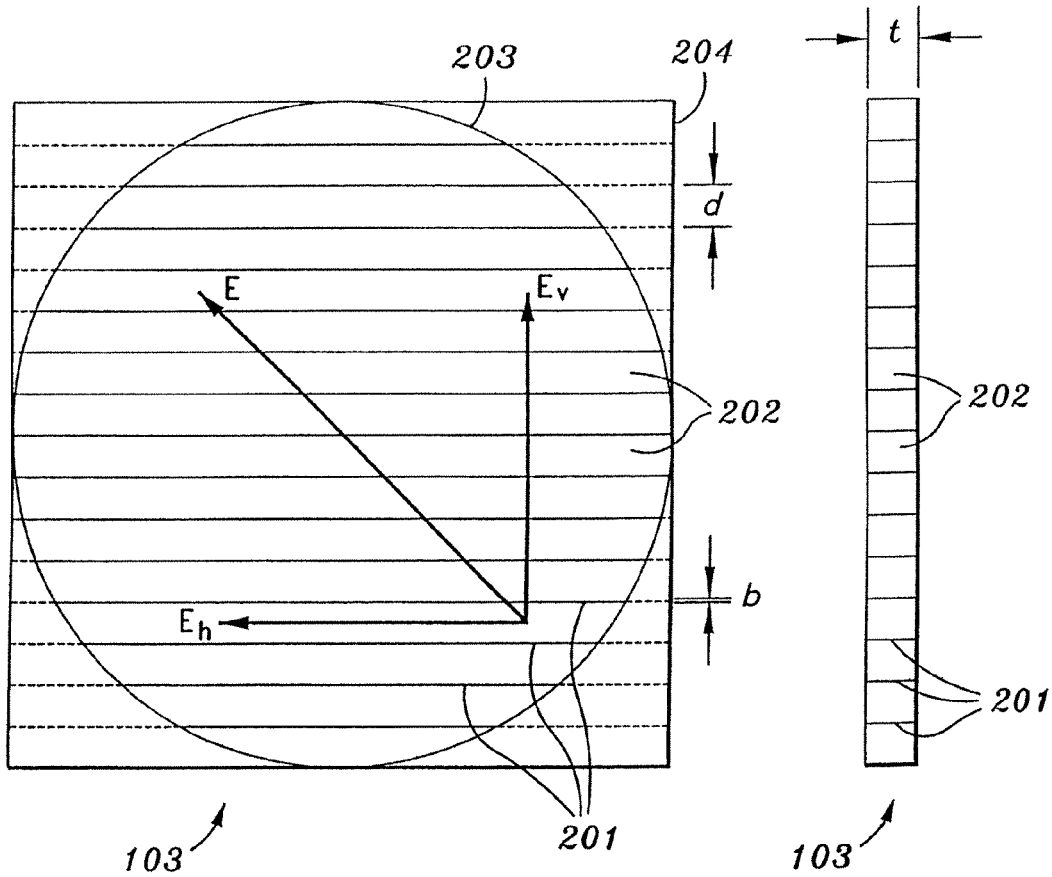
FIG. 2 depicts a parallel plate polarizer according to one aspect of the present invention.

FIG. 2 provides front and side views with greater detail of parallel plate polarizer 103. Parallel plate polarizer 103 includes a number of parallel metal vanes 201. According to one embodiment, vanes 201 are composed of aluminum. In alternate embodiments, vanes 201 may be composed of any metal, although for space applications, lighter metals are preferred. Each metal vane 201 has a breadth b (e.g., as illustrated by the line weight of the vanes in FIG. 2) and is separated from adjacent vanes 201 by a distance d. According to one aspect, a structural material 202 with a low dielectric loss is disposed between adjacent vanes 201 to provide structural support. For example, without limitation, structural material 202 may be P10 foam, Teflon®, Stycast®, or the like. According to one aspect, structural material 202 is secured to vanes 201 using a space-qualified or ground-qualified adhesive. According to other aspects, structural material 202 may be secured to vanes 201 using any one of a number of methods of attachment readily known to one of skill in the art. In an alternate embodiment, no structural material 202 is disposed between adjacent vanes 201, such that ambient air or vacuum exists between vanes 201.

Vanes 201 are radially enclosed by supporting frame 203. While the present exemplary embodiment illustrates a circular frame 203, the scope of the present invention is not limited to a circularly shaped parallel plate polarizer. Rather, polarizers of any shape may be used. In an embodiment in which parallel plate polarizer 103 has a rectilinear shape, a rectangular supporting frame such as supporting frame 204 may be square. Vanes 201 may be secured to supporting frame 203, if desired, using a space-qualified or ground-qualified adhesive, or any other method of attachment known to those of skill in the art.

As can be seen with reference to FIG. 2, parallel plate polarizer 103 acts as a waveguide to the component of incident electromagnetic radiation with polarization along vector $E_h$. As will be apparent to one of skill in the art, this component will experience phase advance as it passes through parallel plate polarizer 103. The orthogonal component $E_v$ will not "see" parallel plate polarizer 103 as a waveguide, and accordingly will not experience this phase advance. A direction parallel to the vanes 201 of parallel plate polarizer 103 is therefore termed a "phase advance orientation." As both orthogonal components travel through parallel plate polarizer 103, the difference in phase between them will increase. For a given breadth b and distance d, the thickness t of parallel plate polarizer 103 is selected to provide a desired differential phase response, which, when combined with the phase response achieved by anisotropic dielectric polarizer 104, totals about 90°.

Figure 3:
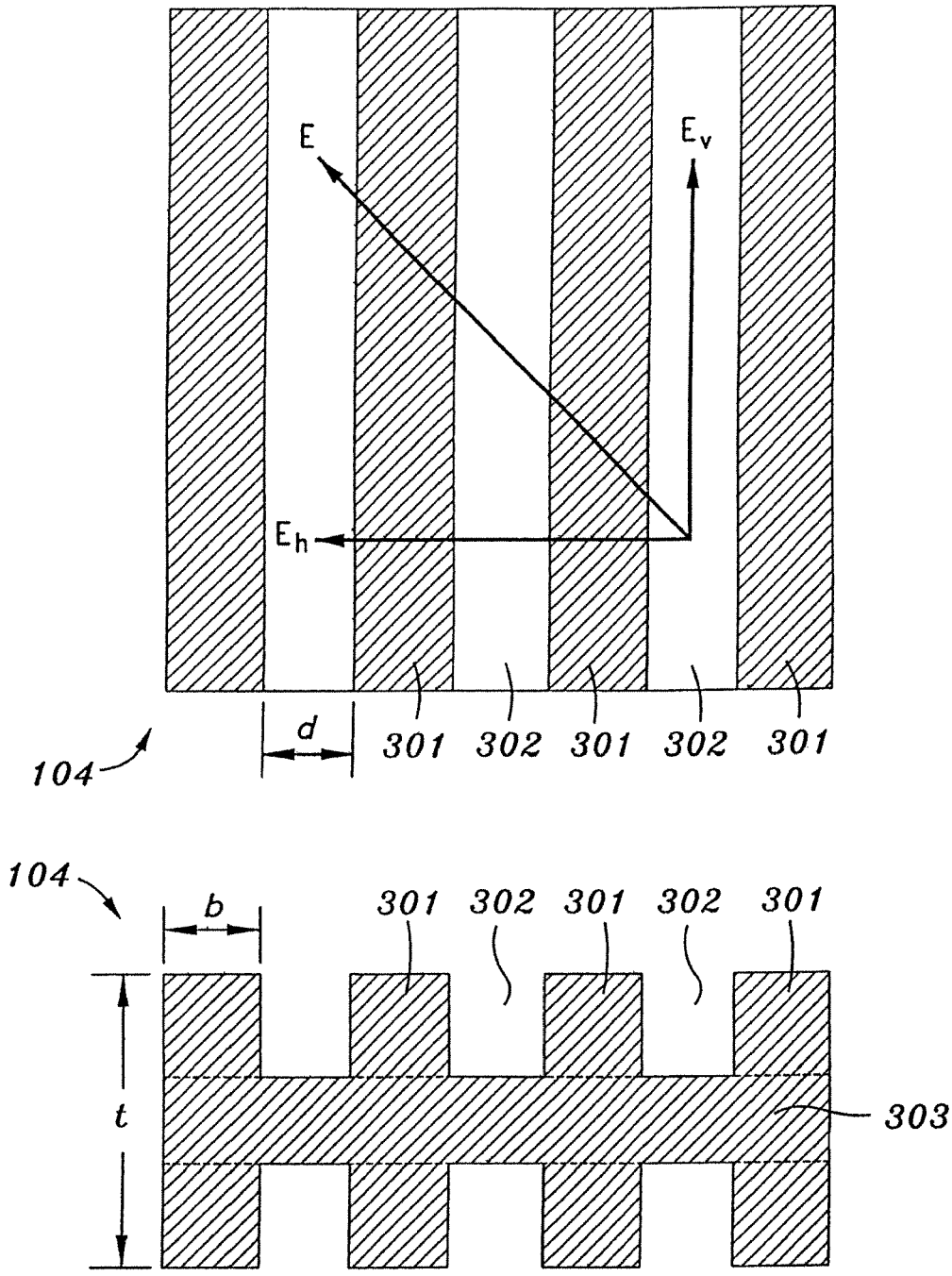
FIG. 3 depicts an anisotropic dielectric polarizer according to another aspect of the present invention.

Turning to FIG. 3, front and top views with greater detail of anisotropic dielectric polarizer 104 are provided, according to one aspect of the present invention. Anisotropic dielectric polarizer 104 includes a number of parallel layers of dielectric material 301. A dielectric material with a low loss tangent is preferred. For example, in one embodiment, anisotropic dielectric polarizer 104 is made of Stycast®, which has a dielectric constant of 2.54 and a loss tangent of less than 0.0005. According to other embodiments, anisotropic dielectric polarizer 104 may be made of Rexolite®, G10 and the like. Each layer of dielectric material 301 has a breadth b, and is separated from adjacent layers of dielectric material 301 by a distance d. According to one embodiment, the breadth b of each layer of dielectric material is equal to the distance d between adjacent layers. Such an arrangement is said to have a 1:1 ratio. According to alternate embodiments, any ratio of breadth to depth may be selected. Breadth b and depth d are selected to ensure a minimum number of layers of dielectric material interact with incident radiation having a component $E_h$.

According to one embodiment, between adjacent layers of dielectric material 301 is left a gap 302, in which either ambient air or vacuum exists, depending upon the environment in which anisotropic dielectric polarizer 104 is used. According to one aspect, anisotropic dielectric polarizer 104 includes a supporting section 303 which permits anisotropic dielectric polarizer 104 to be machined from a single piece of dielectric material. The thickness of supporting section 303 is selected to provide good match, depending on the frequencies of radiation for which anisotropic dielectric polarizer 104 is designed to be used.

According to another embodiment, between adjacent layers of dielectric material 301 are disposed layers of a material with a dielectric constant of about 1. In this embodiment, the supporting section 303 may be omitted, as the low-dielectric material disposed between the layers 301 provides the necessary structural support.

As can be seen with reference to FIG. 3, the component of incident electromagnetic radiation with polarization along vector $E_h$ interacts with a different amount of dielectric material in anisotropic dielectric polarizer 104. As will be apparent to one of skill in the art, this component will experience phase lag as it passes through anisotropic dielectric polarizer 104. The orthogonal component $E_v$ will not "see" anisotropic dielectric polarizer 104 as having as large a dielectric constant as component $E_h$, and accordingly will not experience the same phase lag. A direction parallel to the layers of dielectric material 301 of anisotropic dielectric polarizer 104 is therefore termed a "phase advance orientation." As both orthogonal components travel through anisotropic dielectric polarizer 104, the difference in phase between them will increase. For a given breadth b and distance d, the thickness t of anisotropic dielectric polarizer 104 is selected to provide a desired differential phase response, which, when combined with the phase response achieved by parallel plate polarizer 103, totals about 90°.

The differential phase shift between the orthogonal field components $E_v$ and $E_h$ in each polarizer is determined by the optical thickness of each polarizer in the ordinary and extraordinary polarizations. The differential phase shift characteristics of the polarizers can be arranged to complement each other, such that a phase shift of about 90° can be achieved over a large bandwidth and/or at two desired frequencies. Table 1, below, summarizes the differential phase shifts for each polarizer in an exemplary composite polarizer according to one aspect of the present invention.

TABLE 1

| | Calculated Differential Phase Shift (in degrees) | |
|---|---|---|
| Polarizer Type | Ka-Tx band 20 GHz ($f_1$) | Ka-Rx band 30 GHz ($f_2$) |
| Parallel Plate | 51.1 | 30.75 |
| Anisotropic Dielectric | 39.12 | 58.67 |
| Composite (total shift) | 90.22 | 89.42 |

The parallel plate polarizer used in the exemplary embodiment summarized in Table 1 has aluminum vanes of 0.02" breadth, spaced a distance 0.40" apart, and has an axial thickness of 0.26". The anisotropic dielectric polarizer used in this exemplary embodiment has Stycast® layers of 0.160" breadth, spaced a distance 0.160" apart, and has an axial thickness of 0.595".

Figure 4:
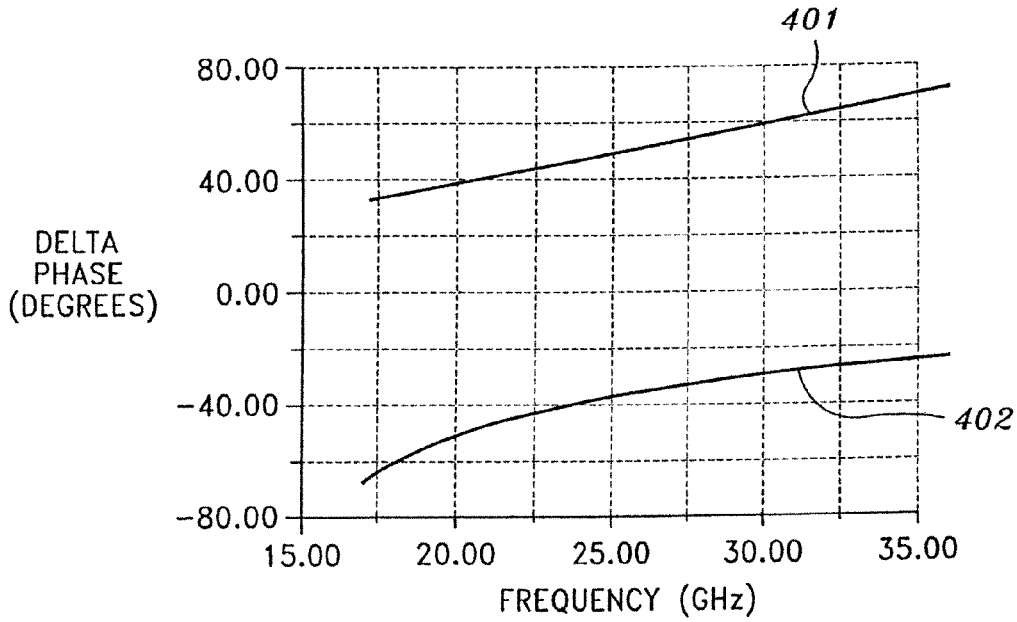
FIG. 4 is a graph illustrating differential phase responses for a parallel plate polarizer and an anisotropic dielectric polarizer according to yet another aspect of the present invention.
Figure 5:
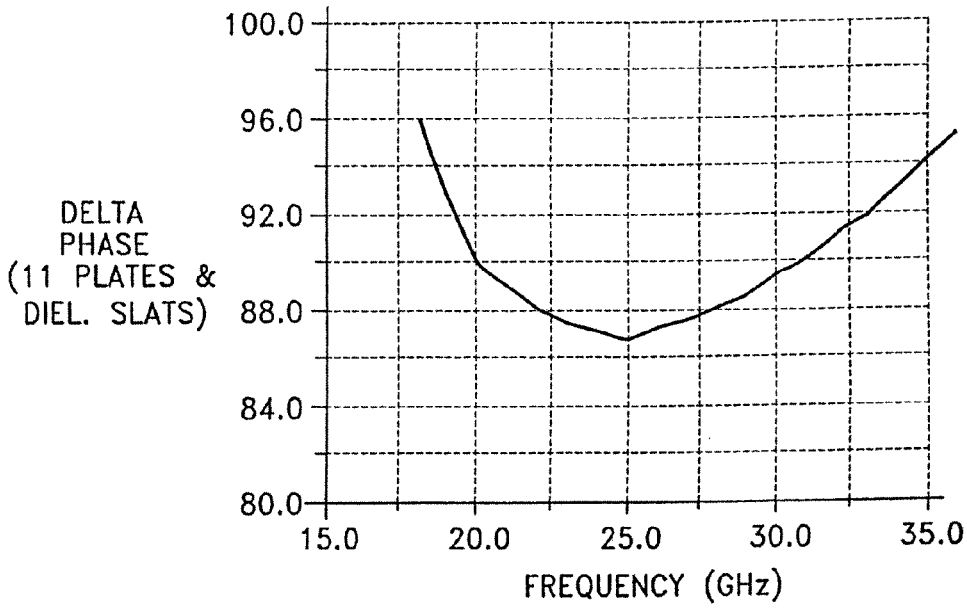
FIG. 5 is a graph illustrating a differential phase response for a composite polarizer according to yet another aspect of the present invention.

FIG. 4 illustrates differential phase responses for a parallel plate polarizer and an anisotropic dielectric polarizer according to one exemplary embodiment of the present invention. The differential phase response of an anisotropic dielectric polarizer 401 and the differential phase response of a parallel plate polarizer 402 can be seen over a range of frequencies from 17 GHz to 35 GHz. FIG. 5 illustrates the total differential phase response for a cascaded polarizer combining the anisotropic dielectric polarizer and the parallel plate polarizer whose differential phase responses are graphed in FIG. 4. It can be seen that the differential phase response for the cascaded polarizer graphed in FIG. 5 remains about 90° (e.g., in this particular embodiment, ±3°) from about 19 GHz to about 32 GHz.

Figure 6:
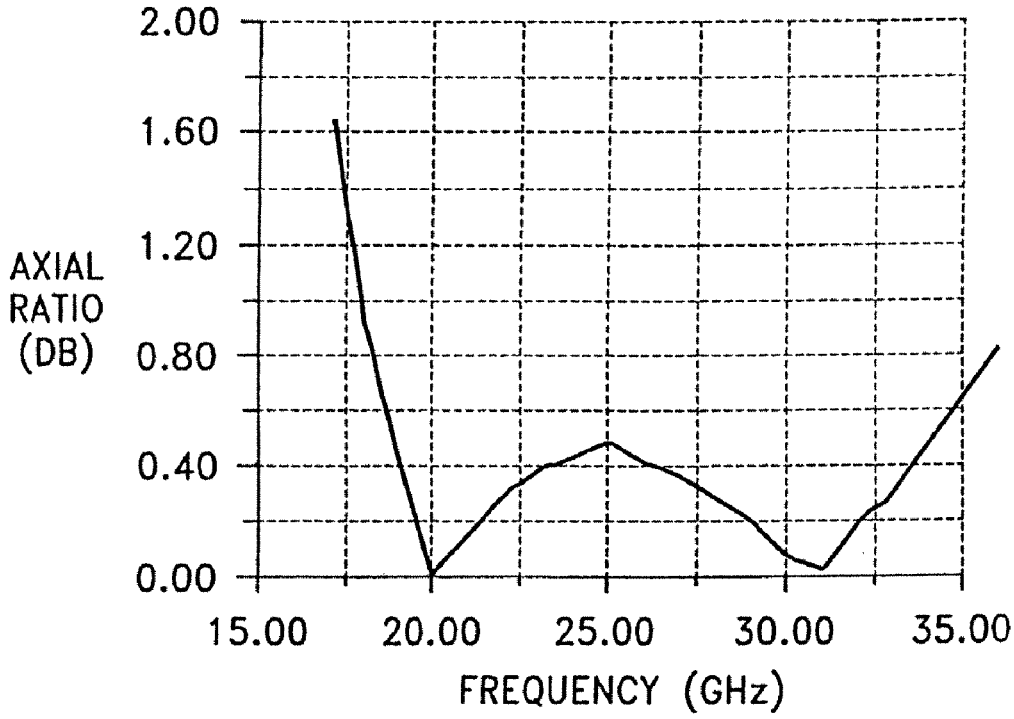
FIG. 6 is a graph illustrating a performance advantage of a composite polarizer according to yet another aspect of the present invention.

FIG. 6 illustrates the axial ratio for radiation transmitted through the composite polarizer whose differential phase response is graphed in FIG. 5. When the axial ratio for the radiation is below about 0.5, the radiation is considered to be circularly, as opposed to elliptically, polarized. It can be seen with reference to FIG. 6 that a composite polarizer of the present invention can provide circularly polarized light over a large bandwidth and can provide circular polarization at two discrete frequencies either closely spaced or widely separated.

According to one aspect, a composite polarizer of the present invention can be made switchable by providing a mechanism for rotating the composite polarizer around the axis. By rotating the composite polarizer such that the incident radiation has a linear polarization parallel or orthogonal (e.g., about 0°, 90° or 180°) to the parallel metal vanes and to the layers of dielectric material, the radiation will experience no differential phase shift. Thus, incident linearly polarized light will remain linearly polarized when the polarizers are in one position, and will be converted to circularly polarized light when the polarizers are in another (e.g., when the parallel structures of the polarizers form an angle of 45° or 135° with the direction of linear polarization). By varying the direction in which the polarizers are rotated with respect to the axis, linearly polarized incident light may be converted to either right-hand circular polarization (RHCP) or left-hand circular polarization (LHCP).

According to one embodiment, both the parallel plate polarizer and the anisotropic dielectric polarizer are independently rotatable. By independently rotating the polarizers with respect to each other, linearly polarized light may be converted to elliptically polarized light with a variety of different axial ratios.

According to one embodiment, the polarization accomplished by a composite polarizer of the present invention can be arranged to match the polarization of radiation of a ground station, in order to minimize polarization mismatch losses. For example, if the polarization of radiation of a ground station is left-handed elliptical polarization with an axial ratio of 0.7, the parallel plate polarizer and the anisotropic dielectric polarizer can be independently rotated to match the polarization of the ground station.

Because of the simplicity of the construction of a composite polarizer according to the present invention, the cost of manufacture is greatly reduced over more complicated systems involving numerous cascaded meander-line polarizers. Moreover, the reduced number of interfaces through which incident radiation must pass results in less power loss and greater power handling abilities than other systems such as meander-line systems. With appropriate design, both the parallel plate polarizer and the anisotropic dielectric polarizer can be useful over a much broader bandwidth than meander-line polarizers.

Figure 7:
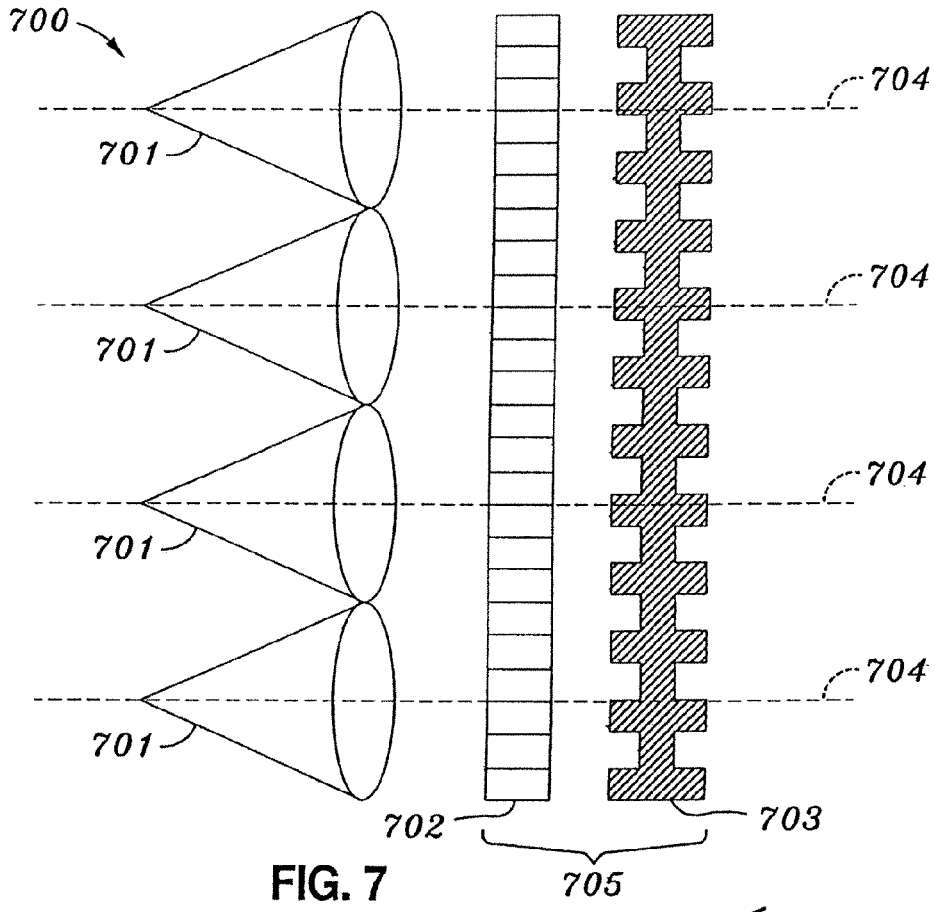
FIG. 7 depicts an antenna system including a composite polarizer according to another embodiment of the present invention.

According to one embodiment, a composite polarizer of the present invention may be included in an antenna system by disposing the composite polarizer in front of and on the axis of one or more linearly polarized antennas. In this manner, one composite polarizer can be used to select the polarization for more than one antenna. FIG. 7 illustrates an antenna system according to one embodiment of the present invention. An antenna system 700 includes several linearly polarized antennas 701 having the same direction of linear polarization. In front of the antennas 701, a composite polarizer 705 is disposed. The composite polarizer includes a rotatable parallel plate polarizer 702 and an anisotropic dielectric polarizer 703, both of which are disposed on the axes 704 of the linearly polarized antennas 701. Each polarizer 702 and 703 has a phase advance orientation as described more fully above. When the phase advance orientation of each polarizer is at either about 45° or about 135° with respect to the direction of linear polarization of the antennas 701, the combined differential phase shift of the composite polarizer 705 is about 90° over a broad bandwidth and/or over multiple widely separated frequency bands.

According to one embodiment, composite polarizer 705 can be arranged to selectively deploy in front of antennas 701. Thus, when circular polarization is desired, composite polarizer 705 is deployed, and when linear polarization is desired, composite polarizer 705 is stowed off of the axes 704 of the antennas 701. Composite polarizer 705 may be arranged to be selectively stowable through the use of a moveable arm, a hinge, or any one of a number of other methods for stowing and deploying polarizers well known to those of skill in the art.

Figure 8:
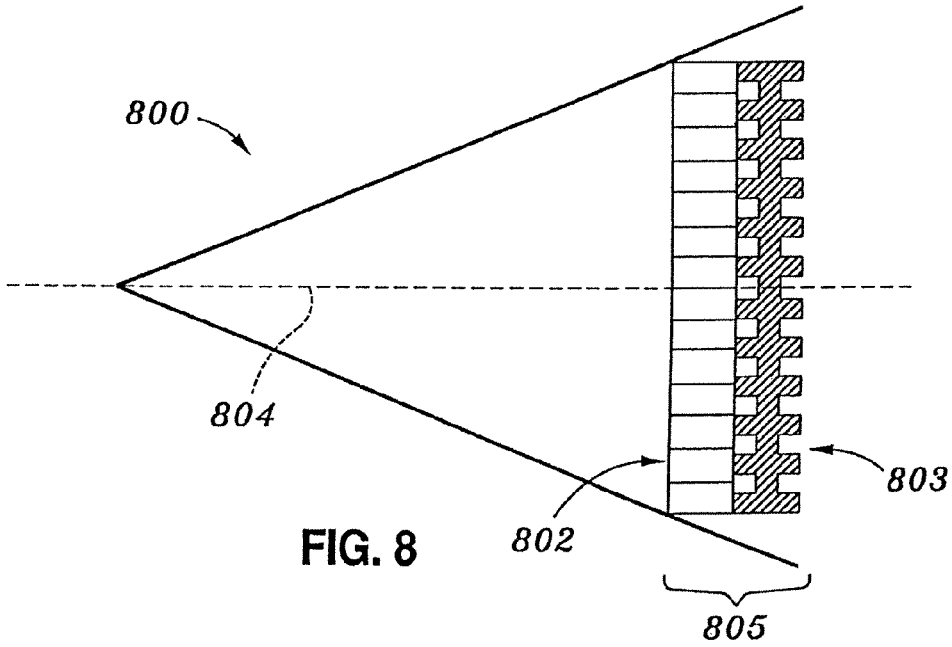
FIG. 8 depicts an antenna system including a composite polarizer according to yet another embodiment of the present invention.

According to another embodiment, a composite polarizer of the present invention may be disposed within the aperture of a single linearly polarized horn antenna. FIG. 8 illustrates such an antenna system. An antenna system 800 includes a linearly polarized antenna 801. In front of antenna 801, a composite polarizer 805 is disposed. The composite polarizer includes a rotatable parallel plate polarizer 802 and an anisotropic dielectric polarizer 803, both of which are disposed on an axis 804 of linearly polarized antenna 801. Each polarizer 802 and 803 has a phase advance orientation as described more fully above. When the phase advance orientation of each polarizer is at either about 45° or about 135° with respect to the direction of linear polarization of antenna 801, the combined differential phase shift of composite polarizer 805 is about 90° over a broad bandwidth and/or over multiple widely separated frequency bands.

Figure 9:
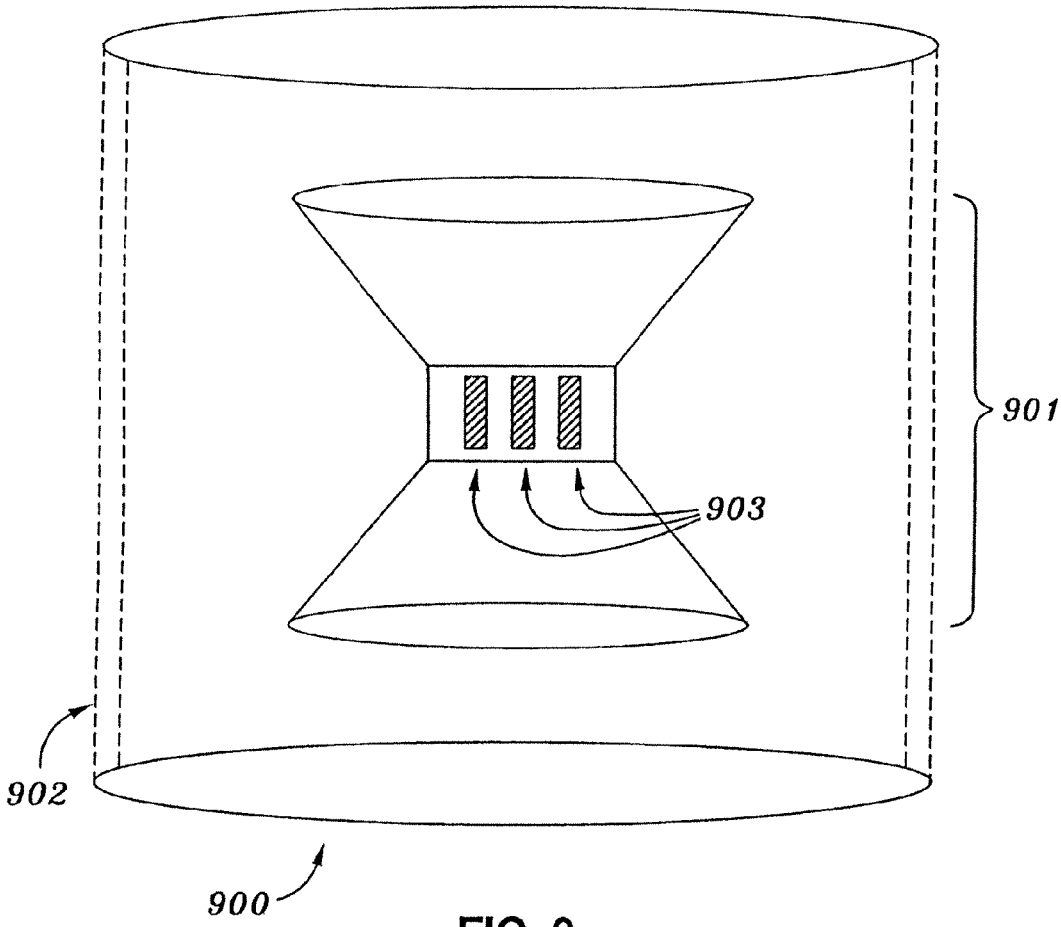
FIG. 9 depicts an OMNI antenna system including a composite polarizer according to yet another embodiment of the present invention.

According to another embodiment, the composite polarizer of the present invention can be formed as a radome around a linearly polarized OMNI antenna. FIG. 9 illustrates such an embodiment. An antenna system 900 includes a linearly polarized OMNI antenna 901 having one or more radiating slots, such as radiating slots 903. Around antenna 901, a composite polarizer 902 in the form of a radome is disposed. The phase advance orientation of each polarizer of the composite polarizer is at either about 45° or about 135° with respect to the direction of linear polarization of antenna 901, resulting in a combined differential phase shift of about 90° over a broad bandwidth and/or over multiple widely separated frequency bands.

While the exemplary embodiments above describe antenna systems in which a parallel plate polarizer rather than an anisotropic dielectric polarizer is disposed closer to a linearly polarized antenna, the scope of the present invention is not limited to such an arrangement. The order of the polarizers may be reversed, with the anisotropic dielectric polarizer being disposed closer to the antenna than the parallel plate polarizer. Moreover, while the exemplary embodiments above describe antenna systems in which only one parallel plate polarizer and only one anisotropic dielectric polarizer comprise a composite polarizer, the scope of the present invention includes arrangements with more than one of either polarizer or of both polarizers.

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope of the invention.

What is claimed is:

1. An antenna system comprising:

a linearly polarized horn antenna with a direction of linear polarization, the antenna having an axis;

a rotatable parallel plate polarizer disposed on the axis inside the linearly polarized horn antenna, the rotatable parallel plate polarizer having a phase advance orientation orthogonal to the axis; and a rotatable anisotropic dielectric polarizer disposed on the axis inside the linearly polarized horn antenna, the rotatable anisotropic dielectric polarizer having a phase advance orientation orthogonal to the axis, wherein, when the phase advance orientation of the rotatable parallel plate polarizer is at an angle of about 45° or about 135° with respect to the direction of linear polarization, and the phase advance orientation of the rotatable anisotropic dielectric polarizer is at an angle of about 45° or about 135° with respect to the direction of linear polarization, the rotatable parallel plate polarizer and the rotatable anisotropic dielectric polarizer have a combined differential phase shift for a first frequency $f_1$ of about 90° and a combined differential phase shift for a second frequency $f_2$ of about 90°.

2. The antenna system of claim 1, wherein when the phase advance orientation of the rotatable parallel plate polarizer is at an angle of about 0° or about 90° or about 180° with respect to the direction of linear polarization, and the phase advance orientation of the rotatable anisotropic dielectric polarizer is at an angle of about 0° or about 90° or about 180° with respect to the direction of linear polarization, the rotatable parallel plate polarizer and the rotatable anisotropic dielectric polarizer have a combined differential phase shift for a first frequency $f_1$ of about 0° and a combined differential phase shift for a second frequency $f_2$ of about 0°.

3. The antenna system of claim 1, wherein the rotatable parallel plate polarizer and the rotatable anisotropic dielectric polarizer are rotatable with respect to each other.

* * * * *